US012247738B2

(12) United States Patent
Ichihashi et al.

(10) Patent No.: US 12,247,738 B2
(45) Date of Patent: Mar. 11, 2025

(54) CONVECTION COOLING AT LOW EFFUSION DENSITY REGION OF COMBUSTOR PANEL

(71) Applicant: United Technologies Corporation, Farmington, CT (US)

(72) Inventors: Fumitaka Ichihashi, Unionville, CT (US); Jeffrey J. Lienau, Wethersfield, CT (US)

(73) Assignee: RTX CORPORATION, Farmington, CT (US)

( * ) Notice: Subject to any disclaimer, the term of this patent is extended or adjusted under 35 U.S.C. 154(b) by 550 days.

(21) Appl. No.: 16/746,432

(22) Filed: Jan. 17, 2020

(65) Prior Publication Data

US 2021/0222879 A1 Jul. 22, 2021

(51) Int. Cl.
*F23R 3/00* (2006.01)

(52) U.S. Cl.
CPC .... *F23R 3/002* (2013.01); *F23R 2900/03041* (2013.01)

(58) Field of Classification Search
CPC ..... F23R 3/002; F23R 2900/03041; F23R 2900/03042
See application file for complete search history.

(56) References Cited

U.S. PATENT DOCUMENTS 7,905,094 B2 3/2011 Dudebout
9,897,320 B2 2/2018 Bronson
2004/0106360 A1* 6/2004 Farmer ..... B24C 7/0007 451/38
2006/0037323 A1 2/2006 Reynolds
2007/0169484 A1* 7/2007 Schumacher ..... F23R 3/002 60/754
2008/0223835 A1* 9/2008 Kuhn ..... B23K 26/389 219/121.71
2009/0071161 A1* 3/2009 Critchley ..... F23R 3/52 60/754
2009/0084110 A1 4/2009 Dudebout et al.
2009/0188256 A1 7/2009 Woodcock
2011/0023495 A1 2/2011 Bronson
2014/0109581 A1 4/2014 Dudebout
(Continued)

OTHER PUBLICATIONS

EP search report for EP21152121.6 daed Jun. 7, 2021.

*Primary Examiner* — Ehud Gartenberg
*Assistant Examiner* — Henry Ng
(74) *Attorney, Agent, or Firm* — Getz Balich LLC

(57) ABSTRACT

A combustor for a gas turbine engine includes a combustion chamber defined between an inner shell and an outer shell. The combustor further includes a bulkhead extending between the inner shell and the outer shell. The combustor further includes a liner panel mounted to one of the inner shell and the outer shell aft of the bulkhead. The liner panel includes a first section including a first plurality of effusion holes. A first portion of the first plurality of effusion holes extends in a substantially circumferential direction. A second portion of the first plurality of effusion holes, disposed forward of the first portion, transitions from the substantially circumferential direction toward a substantially forward direction. A third portion of the first plurality of effusion holes, disposed aft of the first portion, transitions from the substantially circumferential direction to a substantially aft direction.

16 Claims, 7 Drawing Sheets

(56) References Cited

U.S. PATENT DOCUMENTS

| | | | | |
|---|---|---|---|---|
| 2014/0260257 | A1 | 9/2014 | Rullaud | |
| 2016/0273772 | A1* | 9/2016 | Cunha | F23R 3/005 |
| 2016/0281988 | A1* | 9/2016 | Tu, Jr. | F23R 3/002 |
| 2018/0231252 | A1* | 8/2018 | Clemen | F23R 3/002 |
| 2020/0124282 | A1 | 4/2020 | Lewis | |
| 2020/0166211 | A1* | 5/2020 | Dudebout | F23R 3/002 |

* cited by examiner

CONVECTION COOLING AT LOW EFFUSION DENSITY REGION OF COMBUSTOR PANEL

BACKGROUND

1. Technical Field

This disclosure relates generally to combustors for gas turbine engines, and more particularly to cooling of combustor panels.

2. Background Information

Combustors, such as those used in gas turbine engines, may generally include radially spaced inner and outer shells which define a combustion chamber therebetween. The combustor may also include liner panels mounting to the inner and outer shells on their combustion chamber sides. The liner panels may include effusion holes configured to provide cooling to the liner panels by directing cooling air through the effusion holes.

The use of effusion holes having a narrow angle relative to a liner panel surface may provide a greater surface area for cooling air to convectively cool the liner panel as it passes through the effusion holes. However, effusion holes having a narrow angle through the liner panel may not allow for relatively rapid changes in directions of pluralities of effusion holes (e.g., forward to aft) due to the minimum ligament spacing requirements between adjacent effusion holes. It may be desirable to have effusion holes oriented in multiple directions (e.g., forward, aft, circumferentially) to provide improved cooling to the liner panel or other components or to promote efficient circulation of combustion gases but, as a result, density of the effusion holes, and hence convective cooling of the liner panel, may be sacrificed. Accordingly, what is needed is an improved liner panel which addresses one or more of the above-noted concerns.

SUMMARY

It should be understood that any or all of the features or embodiments described herein can be used or combined in any combination with each and every other feature or embodiment described herein unless expressly noted otherwise.

According to an embodiment of the present disclosure, a combustor for a gas turbine engine includes a combustion chamber defined between an inner shell and an outer shell. The combustor further includes a bulkhead extending between the inner shell and the outer shell. The combustor further includes a liner panel mounted to one of the inner shell and the outer shell aft of the bulkhead. The liner panel includes a first section including a first plurality of effusion holes extending through the liner panel between an inner surface and an outer surface. A first portion of the first plurality of effusion holes extends in a substantially circumferential direction. A second portion of the first plurality of effusion holes, disposed forward of the first portion, transitions from the substantially circumferential direction toward a substantially forward direction as a first axial distance from the first portion increases. A third portion of the first plurality of effusion holes, disposed aft of the first portion, transitions from the substantially circumferential direction to a substantially aft direction as a second axial distance from the first portion increases.

In the alternative or additionally thereto, in the foregoing embodiment, the liner panel further includes a second section including a second plurality of effusion holes extending through the liner panel between the inner surface and the outer surface.

In the alternative or additionally thereto, in the foregoing embodiment, the second plurality of effusion holes has a greater density of effusion holes than the first plurality of effusion holes.

In the alternative or additionally thereto, in the foregoing embodiment, each effusion hole of the second plurality of effusion holes is directed in the substantially aft direction from the outer surface to the inner surface.

In the alternative or additionally thereto, in the foregoing embodiment, effusion holes of the second portion of the first plurality of effusion holes are directed toward the bulkhead so as to direct cooling air toward an aft surface of the bulkhead.

In the alternative or additionally thereto, in the foregoing embodiment, a forward end of the liner panel is axially adjacent the aft surface of the bulkhead.

In the alternative or additionally thereto, in the foregoing embodiment, the combustor further includes a heat shield panel mounted to the aft surface of the bulkhead. Effusion holes of the second portion of the first plurality of effusion holes are configured to provide cooling air for cooling the heat shield panel.

In the alternative or additionally thereto, in the foregoing embodiment, effusion holes of the first plurality of effusion holes are oriented through the liner panel at an angle between 15 and 35 degrees relative to the inner surface of the liner panel.

In the alternative or additionally thereto, in the foregoing embodiment, the third portion of the first plurality of effusion holes includes a plurality of effusion hole rows, each effusion hole row extending in the substantially circumferential direction along the liner panel. Effusion holes of each effusion hole row of the plurality of effusion holes rows, proceeding axially aft from the first portion of the first plurality of effusion holes, are directed increasingly toward the substantially aft direction and away from the substantially circumferential direction.

In the alternative or additionally thereto, in the foregoing embodiment, the plurality of effusion hole rows includes at least four effusion hole rows.

According to another embodiment of the present disclosure, a method for convectively cooling a liner panel of a combustor for a gas turbine engine includes providing the combustor including a combustion chamber defined between an inner shell and an outer shell. The combustor further includes a bulkhead extending between the inner shell and the outer shell. The method further includes convectively cooling the liner panel mounted to one of the inner shell and the outer shell aft of the bulkhead with a first plurality of effusion holes disposed in a first section of the liner panel. A first portion of the first plurality of effusion holes extends in a substantially circumferential direction. A second portion of the first plurality of effusion holes, disposed forward of the first portion, transitions from the substantially circumferential direction toward a substantially forward direction as a first axial distance from the first portion increases. A third portion of the first plurality of effusion holes, disposed aft of the first portion, transitions from the substantially circumferential direction to a substantially aft direction as a second axial distance from the first portion increases.

In the alternative or additionally thereto, in the foregoing embodiment, the liner panel further includes a second section including a second plurality of effusion holes extending through the liner panel between the inner surface and the outer surface.

In the alternative or additionally thereto, in the foregoing embodiment, the second plurality of effusion holes has a greater density of effusion holes than the first plurality of effusion holes.

In the alternative or additionally thereto, in the foregoing embodiment, each effusion hole of the second plurality of effusion holes is directed in the substantially aft direction from the outer surface to the inner surface.

In the alternative or additionally thereto, in the foregoing embodiment, the method further includes directing cooling air toward an aft surface of the bulkhead with the second portion of the first plurality of effusion holes.

In the alternative or additionally thereto, in the foregoing embodiment, the method further includes providing a heat shield panel mounted to the aft surface of the bulkhead and cooling the heat shield by directing cooling air toward the heat shield with the second portion of the first plurality of effusion holes.

In the alternative or additionally thereto, in the foregoing embodiment, effusion holes of the first plurality of effusion holes are oriented through the liner panel at an angle between 15 and 35 degrees relative to the inner surface of the liner panel.

According to another embodiment of the present disclosure, a combustor for a gas turbine engine includes a combustion chamber defined between an inner shell and an outer shell. The combustor further includes a bulkhead extending between the inner shell and the outer shell. The combustor further includes a liner panel mounted to one of the inner shell and the outer shell aft of the bulkhead. The liner panel includes a first section including a first plurality of effusion holes extending through the liner panel between an inner surface and an outer surface. A first portion of the first plurality of effusions holes extends in a substantially circumferential direction and a third portion of the first plurality of effusion holes, disposed aft of the first portion, transitions from the substantially circumferential direction to a substantially aft direction as a second axial distance from the first portion increases. The third portion of the first plurality of effusion holes includes a plurality of effusion hole rows. Each effusion hole row extends in the substantially circumferential direction along the liner panel and effusion holes of each effusion hole row of the plurality of effusion hole rows, proceeding axially aft from the first portion of the first plurality of effusion holes, are directed increasingly toward the substantially aft direction and away from the substantially circumferential direction. The effusion hole rows includes at least four effusion hole rows. The effusion holes of the first plurality of effusion holes are oriented through the liner panel at an angle between 15 and 35 degrees relative to the inner surface of the liner panel.

In the alternative or additionally thereto, in the foregoing embodiment, the liner panel further includes a second section including a second plurality of effusion holes extending through the liner panel between the inner surface and the outer surface. The second plurality of effusion holes has a greater density of effusion holes than the first plurality of effusion holes and each effusion hole of the second plurality of effusion holes is directed in the substantially at direction from the outer surface to the inner surface.

In the alternative or additionally thereto, in the foregoing embodiment, a second portion of the first plurality of effusion holes, disposed forward of the first portion, transitions from the substantially circumferential direction toward a substantially forward direction as a first axial distance from the first portion increases.

The present disclosure, and all its aspects, embodiments and advantages associated therewith will become more readily apparent in view of the detailed description provided below, including the accompanying drawings.

DETAILED DESCRIPTION

Figure 1:
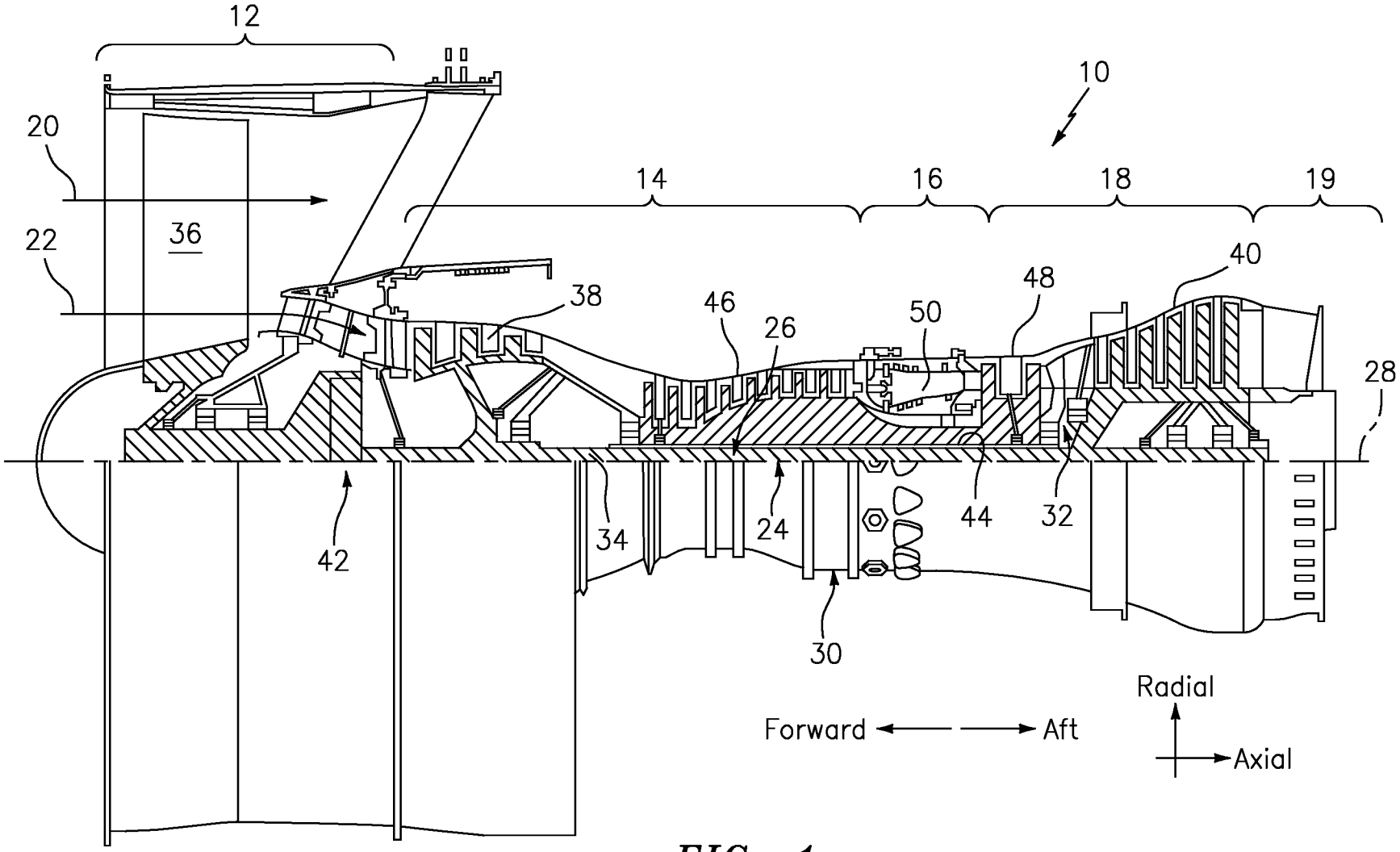
FIG. 1 illustrates a side cross-sectional view of a gas turbine engine in accordance with one or more embodiments of the present disclosure.

It is noted that various connections are set forth between elements in the following description and in the drawings. It is noted that these connections are general and, unless specified otherwise, may be direct or indirect and that this specification is not intended to be limiting in this respect. A coupling between two or more entities may refer to a direct connection or an indirect connection. An indirect connection may incorporate one or more intervening entities. It is further noted that various method or process steps for embodiments of the present disclosure are described in the following description and drawings. The description may present the method and/or process steps as a particular sequence. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the description should not be construed as a limitation.

Referring to FIG. 1, an exemplary gas turbine engine 10 is schematically illustrated. The gas turbine engine 10 is disclosed herein as a two-spool turbofan engine that generally includes a fan section 12, a compressor section 14, a combustor section 16, and a turbine section 18. The fan section 12 drives air along a bypass flowpath 20 while the compressor section 14 drives air along a core flowpath 22 for compression and communication into the combustor section 16 and then expansion through the turbine section 18. Although depicted as a turbofan gas turbine engine in the disclosed non-limiting embodiments, it should be understood that the concepts described herein are not limited to use with turbofans as the teachings may be applied to other types of turbine engines including those with three-spool architectures.

The gas turbine engine 10 generally includes a low-pressure spool 24 and a high-pressure spool 26 mounted for rotation about a longitudinal centerline 28 of the gas turbine engine 10 relative to an engine static structure 30 via one or more bearing systems 32. It should be understood that various bearing systems 32 at various locations may alternatively or additionally be provided.

The low-pressure spool 24 generally includes a first shaft 34 that interconnects a fan 36, a low-pressure compressor 38, and a low-pressure turbine 40. The first shaft 34 may be connected to the fan 36 through a gear assembly of a fan drive gear system 42 to drive the fan 36 at a lower speed than the low-pressure spool 24. The high-pressure spool 26 generally includes a second shaft 44 that interconnects a high-pressure compressor 46 and a high-pressure turbine 48. It is to be understood that "low pressure" and "high pressure" or variations thereof as used herein are relative terms indicating that the high pressure is greater than the low pressure. An annular combustor 50 is disposed between the high-pressure compressor 46 and the high-pressure turbine 48 along the longitudinal centerline 28. The first shaft 34 and the second shaft 44 are concentric and rotate via the one or more bearing systems 32 about the longitudinal centerline 28 which is collinear with respective longitudinal centerlines of the first and second shafts 34, 44.

Airflow along the core flowpath 22 is compressed by the low-pressure compressor 38, then the high-pressure compressor 46, mixed and burned with fuel in the combustor 50, and then expanded over the high-pressure turbine 48 and the low-pressure turbine 40. The low-pressure turbine 40 and the high-pressure turbine 48 rotationally drive the low-pressure spool 24 and the high-pressure spool 26, respectively, in response to the expansion.

Figure 2:
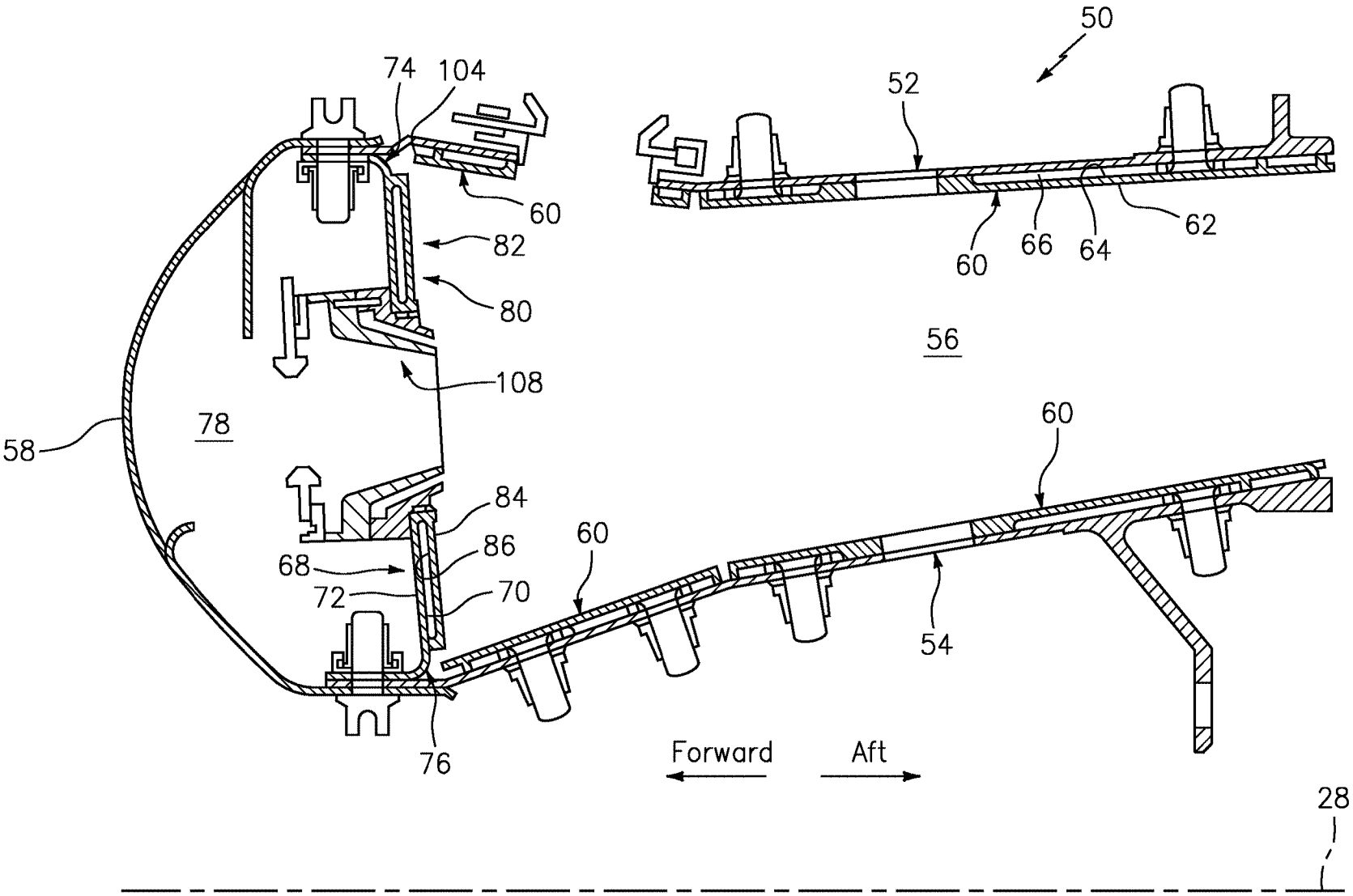
FIG. 2 illustrates a cross-sectional view of an exemplary combustor of a gas turbine engine in accordance with one or more embodiments of the present disclosure.

Referring to FIG. 2, the combustor 50 includes an annular outer shell 52 and an annular inner shell 54 spaced radially inward of the outer shell 52, thus defining an annular combustion chamber 56 therebetween. An annular hood 58 is positioned axially forward of the outer shell 52 and the inner shell 54 and spans between and sealably connects to respective forward ends of the outer shell 52 and the inner shell 54. It should be understood that relative positional terms, such as "forward," "aft," "upper," "lower," "above," "below," and the like are relative to the normal operational attitude of the gas turbine engine 10 and should not be considered otherwise limiting.

The combustor 50 may include one or more liner panels 60 mounted to and spaced away from one or both of the outer shell 52 and the inner shell 54. The liner panel 60 may include an inner surface 62 facing the combustion chamber 56 and an outer surface 64 opposite the inner surface 62. The outer surface 64 of the liner panel 60 may be spaced from the respective shell 52, 54 so as to define a liner cooling chamber 66 therebetween.

The combustor 50 includes a bulkhead 68 having a first surface 70 facing the combustion chamber 56 and a second surface 72 opposite the first surface 70. The bulkhead 68 further includes an outer radial end 74 and an inner radial end 76 opposite the outer radial end 74. The bulkhead 68 may be connected to and extend between the outer shell 52 and the inner shell 54. For example, the bulkhead 68 may be connected to the outer shell 52 at the outer radial end 74 while the bulkhead 68 may be connected to the inner shell 54 at the inner radial end 76. The bulkhead 68 divides the combustion chamber 56 and a hood chamber 78 (i.e., the combustion chamber 56 is disposed downstream of the bulkhead 68 while the hood chamber 78 is disposed upstream of the bulkhead 68). The bulkhead 68 may include an annular heat shield 80 mounted to the first surface 70 of the bulkhead 68 and generally serving to thermally protect the bulkhead 68 and forward portions of the combustor 50, such as the hood chamber 78. The heat shield 80 may include one or more heat shield panels 82. The heat shield panel 82 may include a first surface 84 facing the combustion chamber 56 and a second surface 86 opposite the first surface 84.

Referring to FIGS. 2-6, the liner panel 60 includes a first section 88 having a first plurality of effusion holes 90 disposed therein and extending between the inner surface 62 and the outer surface 64 of the liner panel 60. Cooling air is provided to the liner cooling chamber 66, for example, through a plurality of impingement holes (not shown) disposed through the outer shell 52 and/or inner shell 54. The cooling air within the liner cooling chamber 66 then exits the liner cooling chamber 66 through the first plurality of effusion holes 90 so as to form a film on the outer surface 64 of the liner panel 60 and to provide convective cooling to the liner panel 60. Convective cooling is provided to the liner panel 60 by the cooling air as the cooling air transits the first plurality of effusion holes 90.

The effusion holes of the first plurality of effusion holes 90 may have a "tree root" configuration which provides some effusion cooling flow in a circumferential direction while additionally providing convective cooling to the liner panel 60 in low-density effusion regions of the liner panel 60, such as the first section 88. The "tree root" configuration of the first plurality of effusion holes 90 may provide an increased convective cooling area to the first section 88 of the liner panel 60 while providing a smooth transition of the effusion holes of the first plurality of effusion holes 90 from a forward facing to an aft facing direction of effusion cooling flow. The direction of effusion holes, as used herein, will refer to the direction of an effusion hole center axis 92 (see FIGS. 6A and 6B) from the outer surface 64 to the inner surface 62 of the liner panel 60.

Figure 3:
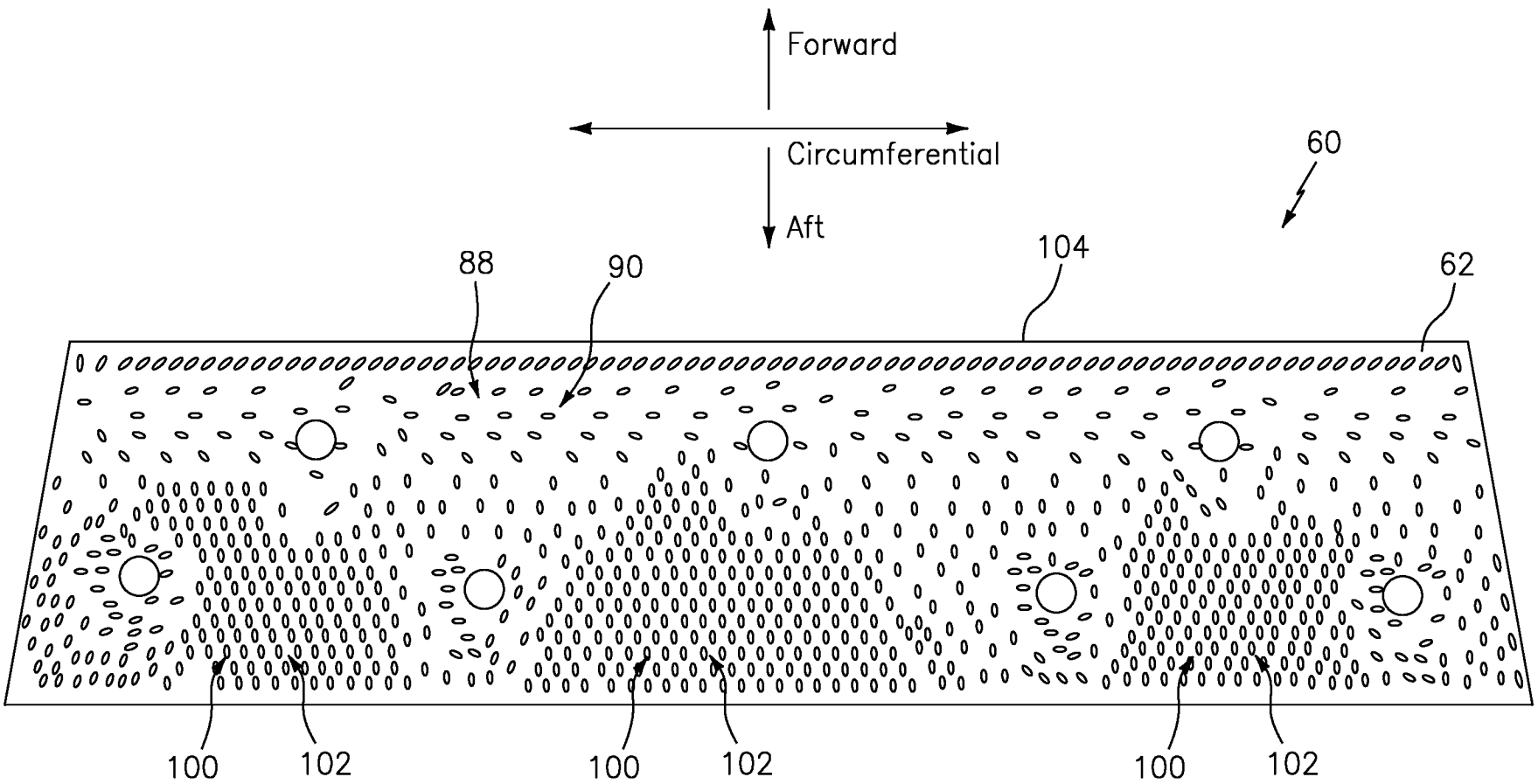
FIG. 3 illustrates a view of a liner panel of the combustor of FIG. 2 from a radially inner position in accordance with one or more embodiments of the present disclosure.
Figure 4:
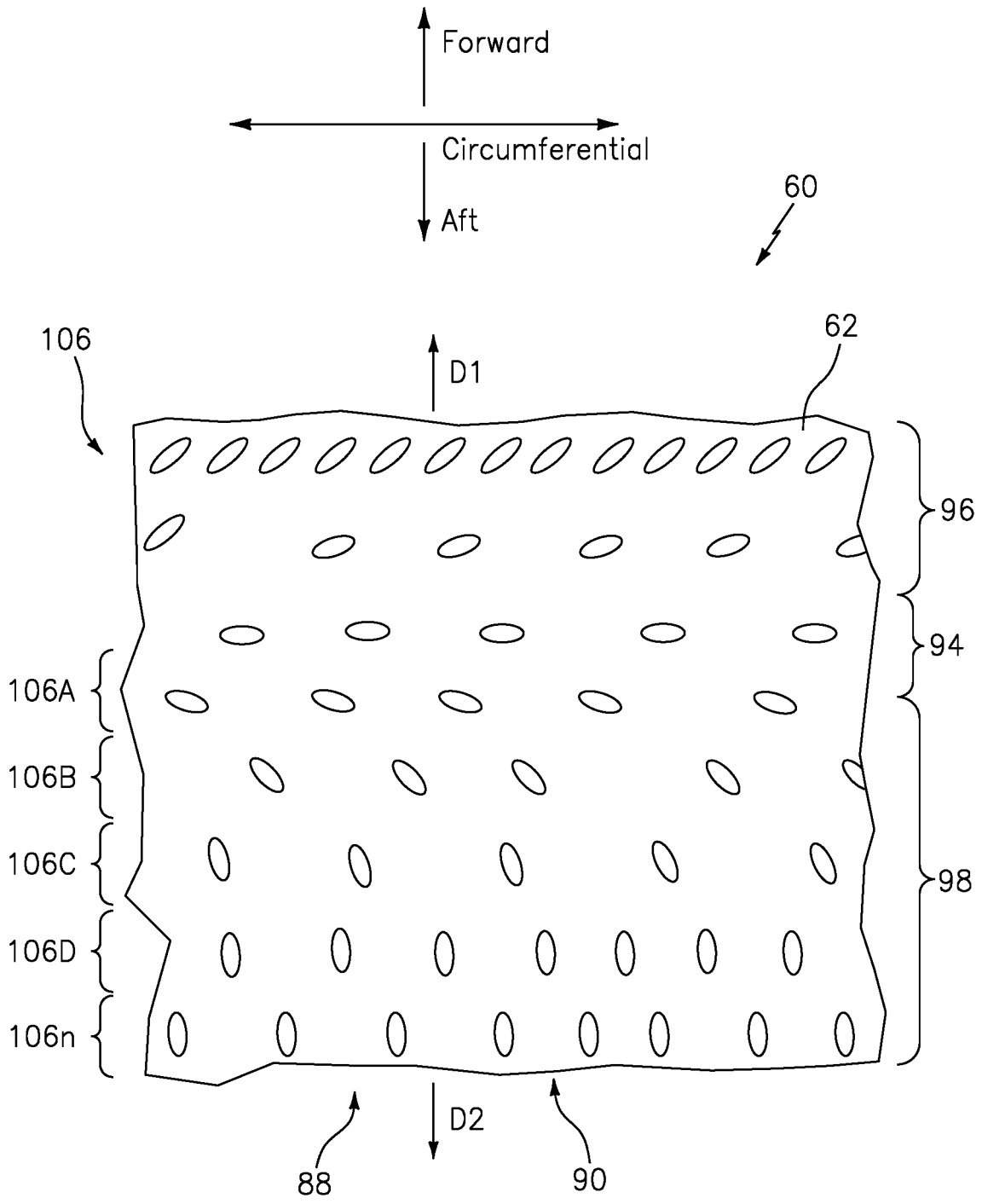
FIG. 4 illustrates a portion of the liner panel of FIG. 3 in accordance with one or more embodiments of the present disclosure.

As illustrated in FIGS. 3 and 4, a first portion 94 of the effusion holes of the first plurality of effusion holes 90 are directed in a substantially circumferential direction through the liner panel 60. A second portion 96 of the first plurality of effusion holes 90 is disposed axially forward of the first portion 94. The second portion 96 of the first plurality of effusion holes 90 transitions from the substantially circumferential direction toward a substantially forward direction as an axial distance D1 from the first portion 94 increases. A third portion 98 of the first plurality of effusion holes 90 is disposed axially aft of the first portion 94. The third portion 98 of the first plurality of effusion holes 90 transitions from the substantially circumferential direction to a substantially aft direction as an axial distance D2 from the first portion 94 increases. As used herein, the term "substantially" with respect to a direction or angle refers to the stated direction or angle +/−five degrees.

In various embodiments, the liner panel 60 includes a second section 100 having a second plurality of effusion holes 102 disposed therein and extending between the inner surface 62 and the outer surface 64 of the liner panel 60. Similar to the effusion holes of the first plurality of effusion holes 90, cooling air within the liner cooling chamber 66 exits the liner cooling chamber 66 through the second plurality of effusion holes 102 so as to form a film on the outer surface 64 of the liner panel 60 and to provide convective cooling to the liner panel 60. Convective cooling is provided to the liner panel 60 by the cooling air as the cooling air transits the second plurality of effusion holes 102.

The second section 100 of the liner panel 60 may be a high-density effusion region of the liner panel 60 relative to the first section 88. Accordingly, the second plurality of effusion holes 102 may have a greater density of effusion holes than the first plurality of effusion holes 90. For example, the second plurality of effusion holes 102 may represent a greater portion of a volume of the second section 100 of the liner panel 60 compared to a portion of a volume of the first section 88 represented by the first plurality of effusion holes 90. In various embodiments, each effusion hole of the second plurality of effusion holes 102 may be directed in a same direction as each other effusion hole of the second plurality of effusion holes 102. In various embodiments, each of the effusion holes of the second plurality of effusion holes 102 may be directed in the substantially aft direction.

Figure 5:
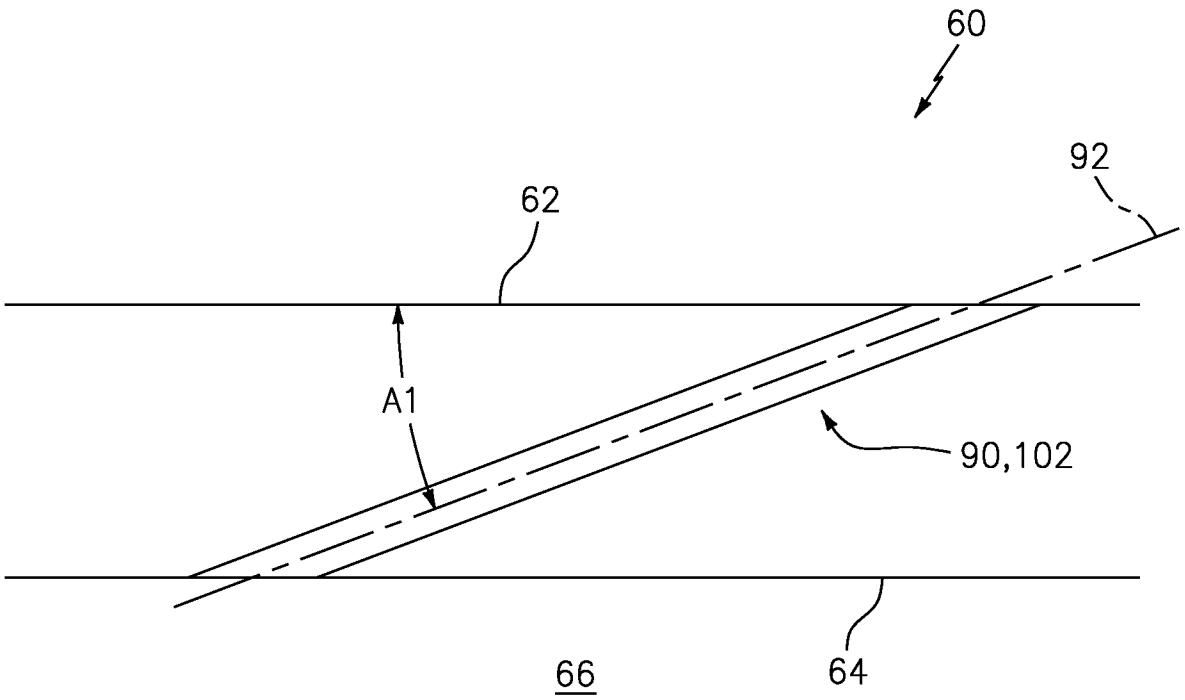
FIG. 5 illustrates a cross-sectional side view of a portion of the liner panel of FIG. 3 in accordance with one or more embodiments of the present disclosure.

As illustrated in FIG. 5, effusion holes of the first and second pluralities of effusion holes 90, 102 may be oriented through the liner panel 60 at an angle A1 relative to the inner surface 62 of the liner panel 60 with respect to the effusion hole center axis 92. In various embodiments, the effusion holes of the first and second pluralities of effusion holes 90, 102 may be oriented at an angle A1 of between 15 and 45 degrees relative to the inner surface 62 of the liner panel 60. In various embodiments, the effusion holes of the first and second pluralities of effusion holes 90, 102 may be oriented at an angle A1 of between 15 and 25 degrees relative to the inner surface 62 of the liner panel 60. In various embodiments, the effusion holes of the first plurality of effusion holes 90 may be oriented at an angle A1 that is different than a respective angle A1 of the effusion holes of the second plurality of effusion holes 102. For example, in various embodiments, the effusion holes of the second plurality of effusion holes 102 may be oriented at an angle A1 that is greater than a respective angle A1 of the first plurality of effusion holes 90. As used herein, a range of values should be understood to be inclusive of the endpoints of the range of values.

In various embodiments, the liner panel 60 may be a forward liner panel having a forward end 104 which is axially adjacent the first surface 70 of the bulkhead 68. In embodiments having the annular heat shield 80, the forward end 104 of the liner panel 60 may be axially adjacent the first surface 84 of the one or more heat shield panels 82. Accordingly, in various embodiments, the second portion 96 of the first plurality of effusion holes 90 may be directed toward the bulkhead 68 and/or the one or more heat shield panels 82 so as to direct cooling air toward the bulkhead 68 and/or the one or more heat shield panels 82.

In various embodiments, the effusion holes of the first plurality of effusion holes 90 may be arranged as a plurality of effusion hole rows 106 with each effusion hole row of the plurality of effusion hole rows 106 extending in a substantially circumferential direction along the liner panel 60. For example, the effusion holes of the third portion 98 of the first plurality of effusion holes 90 may be arranged as a plurality of effusion hole rows 106A-n proceeding axially aft from the first portion 94 of the first plurality of effusion holes 90. Each proceeding effusion hole row 106A-n from the first portion 94 in the aft direction includes effusion holes, each of which are directed increasingly toward the substantially aft direction and away from the substantially circumferential direction. The effusion holes of each effusion hole row of the plurality of effusion hole rows 106A-n may each be substantially directed in the same direction relative to the substantially aft and substantially circumferential directions.

In various embodiments, the plurality of effusion hole rows 106A-n of the second portion 96 of the first plurality of effusion holes 90 includes at least four effusion hole rows, where the last effusion hole row 106*n* of the plurality of effusion hole rows 106A-n is a first effusion hole row from the first portion 94 having effusion holes directed in the substantially aft direction. For example, FIG. 4 illustrates the third portion 98 including five effusion hole rows of the plurality of effusion hole rows 106A-n with the fifth effusion hole row (e.g., the effusion hole row 106*n*) including effusion holes directed in the substantially circumferential direction. Accordingly, the first plurality of effusion holes 90 may include effusion hole rows in addition to the plurality of effusion hole rows 106A-n. In various embodiments, the effusion hole rows of the plurality of effusion hole rows 106A-n may not extend the entire circumferential distance across the liner panel 60 (e.g., an effusion hole row of the plurality of effusion hole rows 106A-n may be circumferentially interrupted by the second plurality of effusion holes 102).

Figure 6A:
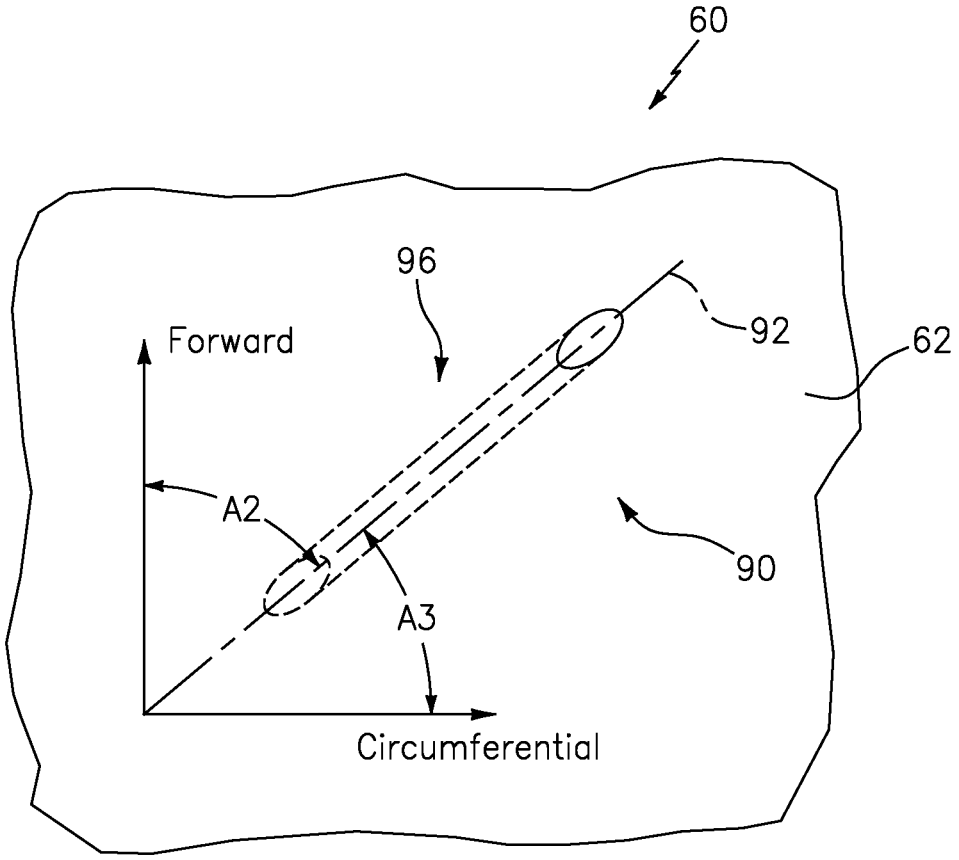
FIG. 6A illustrates a portion of the liner panel of FIG. 3 in accordance with one or more embodiments of the present disclosure.
Figure 6B:
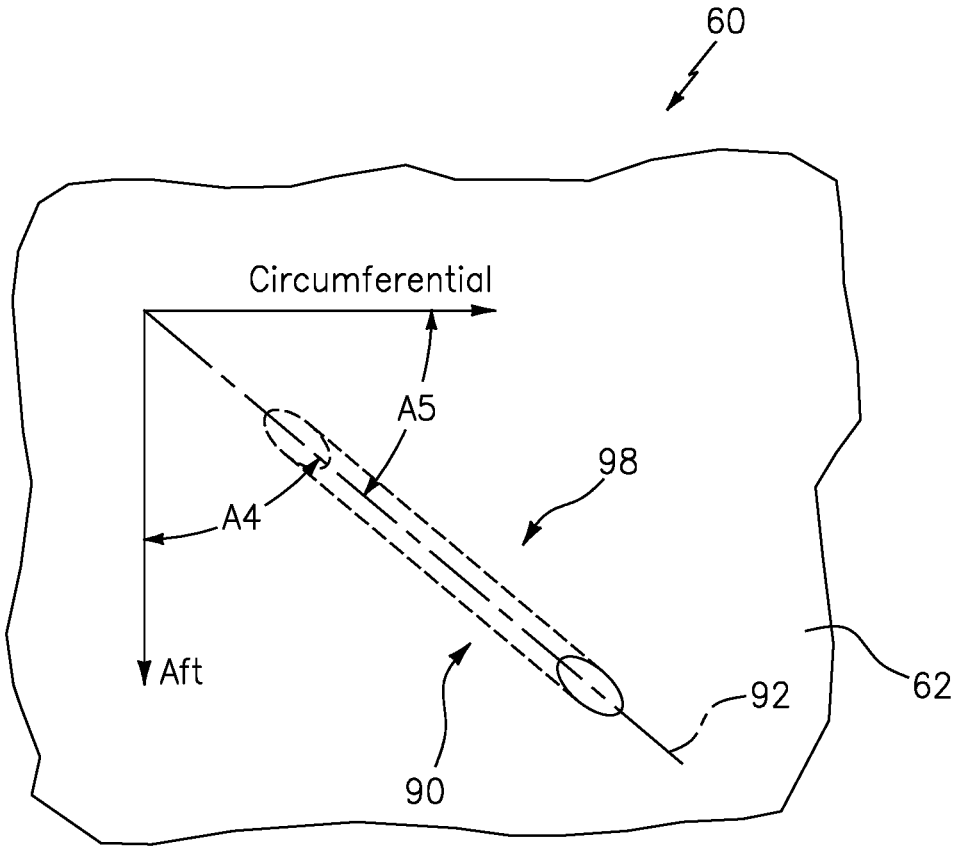
FIG. 6B illustrates a portion of the liner panel of FIG. 3 in accordance with one or more embodiments of the present disclosure.

As illustrated in FIGS. 6A and 6B and discussed above, the effusion holes of the second portion 96 of the first plurality of effusion holes 90 gradually transition from the substantially circumferential direction toward the substantially forward direction as the axial distance D1 from the first portion 94 increases. Accordingly, for each effusion hole of the second portion 96, as the axial distance D1 from the first portion 94 increases, an angle A2 between the substantially forward direction and the effusion hole center axis 92 may decrease while an angle A3 between the substantially circumferential direction and the effusion hole center axis 92 may increase. Similarly, the effusion holes of the third portion 98 of the first plurality of effusion holes 90 gradually transition from the substantially circumferential direction toward the substantially aft direction as the axial distance D2 from the first portion 94 increases. Accordingly, for each effusion hole of the third portion 98, as the axial distance D2 from the first portion 94 increases, an angle A4 between the substantially aft direction and the effusion hole center axis 92 may decrease while an angle A5 between the substantially circumferential direction and the effusion hole center axis 92 may increase.

Circumferential effusion flow may be desirable in the low-density region represented by the first section 88 of the liner panel 60 in order to provide film cooling of the liner panel 60 in the circumferential direction as well as to further promote swirling of combustor gases which have entered the combustion chamber 56 via one or more fuel injectors (not shown) and swirlers 108. The "tree root" configuration of the first plurality of effusion holes 90, as described herein, may provide circumferential flow of effusion cooling air while the gradual transition of the effusion holes from the substantially circumferential direction to the substantially forward and aft directions may provide for a greater density of effusion holes within the first section 88 of the liner panel 60, thereby providing improved convective cooling of the liner panel 60.

While various aspects of the present disclosure have been disclosed, it will be apparent to those of ordinary skill in the art that many more embodiments and implementations are possible within the scope of the present disclosure. For example, the present disclosure as described herein includes several aspects and embodiments that include particular features. Although these particular features may be described individually, it is within the scope of the present disclosure that some or all of these features may be combined with any one of the aspects and remain within the scope of the present disclosure. References to "various embodiments," "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described. Accordingly, the present disclosure is not to be restricted except in light of the attached claims and their equivalents.

What is claimed is:

1. A combustor for a gas turbine engine, the combustor comprising:

a combustion chamber defined between an inner shell and an outer shell;

a bulkhead extending between the inner shell and the outer shell; and a liner panel mounted to one of the inner shell and the outer shell aft of the bulkhead, the liner panel extending axially between a forward end and an aft end, the forward end forming a leading edge of the liner panel and the aft end forming a trailing edge of the liner panel, the liner panel comprising:

a first section comprising a first plurality of effusion holes extending through the liner panel between an inner surface and an outer surface, a first portion of the first plurality of effusion holes extending in a substantially circumferential direction, a second portion of the first plurality of effusion holes, disposed at the leading edge and forward of the first portion, transitioning from the substantially circumferential direction toward a substantially forward direction, from the outer surface to the inner surface, as a first axial distance from the first portion increases, the second portion extending axially from the leading edge to the first portion, a third portion of the first plurality of effusion holes, disposed aft of the first portion, each of the effusion holes of the third portion transitioning from the substantially circumferential direction to a substantially aft direction, from the outer surface to the inner surface, as a second axial distance from the first portion increases, the third portion extending axially from the first portion to the trailing edge; and a second section comprising a second plurality of effusion holes extending through the liner panel between the inner surface and the outer surface, the second plurality of effusion holes having a greater density of effusion holes than the first plurality of effusion holes;

wherein the effusion holes of the first plurality of effusion holes are oriented through the liner panel at a first angle relative to the inner surface of the liner panel and the effusion holes of the second plurality of effusion holes are oriented through the liner panel at a second angle relative to the inner surface of the liner panel, the second angle different than the first angle.

2. The combustor of claim 1, wherein each effusion hole of the second plurality of effusion holes is directed in the substantially aft direction from the outer surface to the inner surface.

3. The combustor of claim 2, wherein the effusion holes of the second portion of the first plurality of effusion holes are directed toward the bulkhead so as to direct cooling air toward an aft surface of the bulkhead.

4. The combustor of claim 3, wherein the forward end of the liner panel is axially adjacent the aft surface of the bulkhead.

5. The combustor of claim 3, further comprising a heat shield panel mounted to the aft surface of the bulkhead, wherein the effusion holes of the second portion of the first plurality of effusion holes are configured to provide cooling air for cooling the heat shield panel.

6. The combustor of claim 2, wherein the third portion of the first plurality of effusion holes comprises a plurality of effusion hole rows, each effusion hole row extending in the substantially circumferential direction along the liner panel and wherein the effusion holes of each effusion hole row of the plurality of effusion hole rows, proceeding axially aft from the first portion of the first plurality of effusion holes, are directed increasingly toward the substantially aft direction and away from the substantially circumferential direction.

7. The combustor of claim 6, wherein the plurality of effusion hole rows comprises at least four effusion hole rows.

8. The combustor of claim 1, wherein the first angle is between 15 and 35 degrees relative to the inner surface of the liner panel.

9. A method for convectively cooling a liner panel of a combustor for a gas turbine engine, the liner panel extending axially between a forward end and an aft end, the forward end forming a leading edge of the liner panel and the aft end forming a trailing edge of the liner panel, the method comprising:

providing the combustor comprising a combustion chamber defined between an inner shell and an outer shell, the combustor further comprising a bulkhead extending between the inner shell and the outer shell;

convectively cooling the liner panel mounted to one of the inner shell and the outer shell aft of the bulkhead with a first plurality of effusion holes disposed in a first section of the liner panel, a first portion of the first plurality of effusion holes extending in a substantially circumferential direction, a second portion of the first plurality of effusion holes, disposed at the leading edge and forward of the first portion, transitioning from the substantially circumferential direction toward a substantially forward direction, from an outer surface of the liner panel to an inner surface of the liner panel, as a first axial distance from the first portion increases, the second portion extending axially from the leading edge to the first portion, a third portion of the first plurality of effusion holes, disposed aft of the first portion, each of the effusion holes of the third portion transitioning from the substantially circumferential direction to a substantially aft direction, from the outer surface to the inner surface, as a second axial distance from the first portion increases, the third portion extending axially from the first portion to the trailing edge; and convectively cooling the liner panel with a second plurality of effusion holes disposed in a second section of the liner panel, the second plurality of effusion holes having a greater density of effusion holes than the first plurality of effusion holes;

wherein the effusion holes of the first plurality of effusion holes are oriented through the liner panel at a first angle relative to the inner surface of the liner panel and the effusion holes of the second plurality of effusion holes are oriented through the liner panel at a second angle relative to the inner surface of the liner panel, the second angle different than the first angle.

10. The method of claim 9, wherein each effusion hole of the second plurality of effusion holes is directed in the substantially aft direction from the outer surface to the inner surface.

11. The method of claim 10, further comprising directing cooling air toward an aft surface of the bulkhead with the second portion of the first plurality of effusion holes.

12. The method of claim 11, further comprising providing a heat shield panel mounted to the aft surface of the bulkhead and cooling the heat shield panel by directing cooling air toward the heat shield panel with the second portion of the first plurality of effusion holes.

13. The method of claim 9, wherein the first angle is between 15 and 35 degrees relative to the inner surface of the liner panel.

14. A combustor for a gas turbine engine, the combustor comprising:

a combustion chamber defined between an inner shell and an outer shell;

a bulkhead extending between the inner shell and the outer shell; and a liner panel mounted to one of the inner shell and the outer shell aft of the bulkhead, the liner panel comprising:

a first section comprising a first plurality of effusion holes extending through the liner panel between an inner surface and an outer surface, a first portion of the first plurality of effusion holes extending in a substantially circumferential direction and a third portion of the first plurality of effusion holes, disposed aft of the first portion, transitioning from the substantially circumferential direction to a substantially aft direction, from the outer surface to the inner surface, as a second axial distance from the first portion increases, the third portion of the first plurality of effusion holes comprising a plurality of effusion hole rows, each effusion hole row extending in the substantially circumferential direction along the liner panel and the effusion holes of each effusion hole row of the plurality of effusion hole rows, proceeding axially aft from the first portion of the first plurality of effusion holes, are directed increasingly toward the substantially aft direction and away from the substantially circumferential direction, the plurality of effusion hole rows comprising at least four effusion hole rows; and a second section comprising a second plurality of effusion holes extending through the liner panel between the inner surface and the outer surface, the second plurality of effusion holes having a greater density of effusion holes than the first plurality of effusion holes and each effusion hole of the second plurality of effusion holes being directed in the substantially aft direction from the outer surface to the inner surface, at least one effusion hole row of the plurality of effusion hole rows circumferentially interrupted by the second plurality of effusion holes such that the second plurality of effusion holes are disposed circumferentially between two effusion holes of the at least one effusion hole row.

15. The combustor of claim 14, wherein the effusion holes of the first plurality of effusion holes are oriented through the liner panel at an angle between 15 and 35 degrees relative to the inner surface of the liner panel.

16. The combustor of claim 14, wherein a second portion of the first plurality of effusion holes, disposed forward of the first portion, transitions from the substantially circumferential direction toward a substantially forward direction, from the outer surface to the inner surface, as a first axial distance from the first portion increases.

* * * * *